US008201916B2

(12) United States Patent
Mizutani et al.

(10) Patent No.: US 8,201,916 B2
(45) Date of Patent: Jun. 19, 2012

(54) IMAGE RECORDER

(75) Inventors: Shunsuke Mizutani, Aichi (JP); Kenta Horade, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 284 days.

(21) Appl. No.: 12/725,085

(22) Filed: Mar. 16, 2010

(65) Prior Publication Data

US 2011/0050780 A1 Mar. 3, 2011

(30) Foreign Application Priority Data

Aug. 31, 2009 (JP) ..... 2009-201050

(51) Int. Cl.
*B41J 29/393* (2006.01)

(52) U.S. Cl. ..... 347/19; 347/16

(58) Field of Classification Search ..... 347/2, 3, 347/5, 14, 16, 19, 101, 104, 105; 358/1.11–1.18; 399/38, 70, 75–77
See application file for complete search history.

(56) References Cited

U.S. PATENT DOCUMENTS 7,298,388 B2 * 11/2007 Hsieh et al. ..... 347/218
7,450,141 B2 * 11/2008 Yamamoto ..... 347/214

FOREIGN PATENT DOCUMENTS

JP 4329166 11/1992

* cited by examiner

*Primary Examiner* — Juanita D Jackson
(74) *Attorney, Agent, or Firm* — Scully, Scott, Murphy & Presser, PC

(57) ABSTRACT

An image recorder includes a driving source generating any of a first-direction force and a second-direction force, a function executing mechanism executing a functional operation, a switching mechanism switching between a first state to allow the function executing mechanism to execute the functional operation and a second state to forbid the function executing mechanism to execute the functional operation, a transmission mechanism transmitting the first-direction force to a feed roller unit and the function executing mechanism and transmitting the second-direction force to the feed roller unit and the switching mechanism, and a controller that after detection of a sheet on a tray, controls the driving source to generate the second-direction force such that the switching mechanism switches to the second state, and thereafter controls the driving source to generate the first-direction force such that the feed roller unit nips the sheet on the tray.

6 Claims, 10 Drawing Sheets

IMAGE RECORDER

CROSS-REFERENCE TO RELATED APPLICATION

This application claims priority under 35 U.S.C. §119 from Japanese Patent Application No. 2009-201050 filed on Aug. 31, 2009. The entire subject matter of the application is incorporated herein by reference.

BACKGROUND

1. Technical Field

The following description relates to one or more image recorders configured to record an image on a sheet, in particular, to one or more image recorders configured such that a user makes a leading end of a sheet directly contact a pair of feed rollers disposed on a sheet feeding path.

2. Related Art

Image recorders have been known that are configured such that a user makes a sheet contact a nipping point between two feed rollers as a set reference position. As an example of such image recorders, a printer has been known, in which a user makes a sheet contact a nipping point between two feed rollers while manually feeding the sheet along a sheet guide. Then, using a sheet insertion detector, a control circuit detects the insertion of the sheet between the feed rollers. In response to the detection of the sheet inserted between the feed rollers, the control circuit controls a motor driver to drive the feed rollers, so as to feed the sheet.

Thus, according to the aforementioned printer, since the user can make a sheet contact the nipping point between the feed rollers, a pickup roller (to be provided separately from the feed rollers) for conveying the sheet from a tray to the nipping point are not required. Therefore, it is possible to save the manufacturing cost of the printer.

SUMMARY

Further, an image recorder has been known that has a single driving source used in common for driving a pair of feed rollers and another mechanism.

In the aforementioned printer, a sheet is required to be nipped in the nipping point between the feed rollers. Therefore, to nip the sheet between the feed rollers, for instance, a control mechanism may be provided that is configured to rotate the feed rollers in a forward direction by a predetermined distance (e.g., several millimeters) after the user makes the sheet contact the nipping point between the feed rollers.

However, when such a structure that a single driving source is used in common for driving the feed rollers and another mechanism is applied to the aforementioned printer, the following problem might be caused.

For example, it is assumed that a driving source for driving the feed rollers is employed as well for driving a suction mechanism configured to suck ink from one or more nozzles for discharging drops of ink onto a sheet. In this case, each time the feed rollers are driven to nip a sheet, the suction mechanism sucks some ink from the nozzles. Thus, it results in an increased amount of ink consumption. Furthermore, it is assumed that the driving source for driving the feed rollers is employed as well for driving a pickup roller configured to feed a sheet forward from a tray. In this case, each time the feed rollers are driven to nip a sheet, the pickup roller feeds another sheet from the tray.

Aspects of the present invention are advantageous to provide one or more improved image recorders configured to control feed rollers to nip a sheet that is manually rendered in contact with a nipping point between the feed rollers, without exerting on the image recorder a negative influence that could be caused by driving any other mechanism with a driving source used in common for driving the feed rollers.

According to aspects of the present invention, an image recorder is provided, which includes a first tray configured such that a sheet is placed thereon, a driving source configured to generate a driving force in any of a first direction and a second direction different from the first direction, a feed roller unit configured to, in response to receipt of the driving force in the first direction from the driving source, nip a leading end of the sheet placed on the first tray, a function executing mechanism configured to, in response to receipt of the driving force in the first direction from the driving source, execute a predetermined functional operation, a switching mechanism configured to switch between a first state to allow the function executing mechanism to execute the predetermined functional operation, and a second state to forbid the function executing mechanism to execute the predetermined functional operation, a transmission mechanism configured to transmit the driving force in the first direction from the driving source to the feed roller unit and the function executing mechanism, and transmit the driving force in the second direction from the driving source to the feed roller unit and the switching mechanism, a sheet detector configured to detect the sheet placed on the first tray, and a controller configured to, in response to the sheet detector detecting the sheet placed on the first tray, control the driving source to generate the driving force in the second direction such that the switching mechanism, which receives the driving force in the second direction from the driving source via the transmission mechanism, switches to the second state, and thereafter control the driving source to generate the driving force in the first direction such that the feed roller unit, which receives the driving force in the first direction from the driving source via the transmission mechanism, nips the sheet on the first tray.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described with reference to the accompany drawings.

Figure 1:
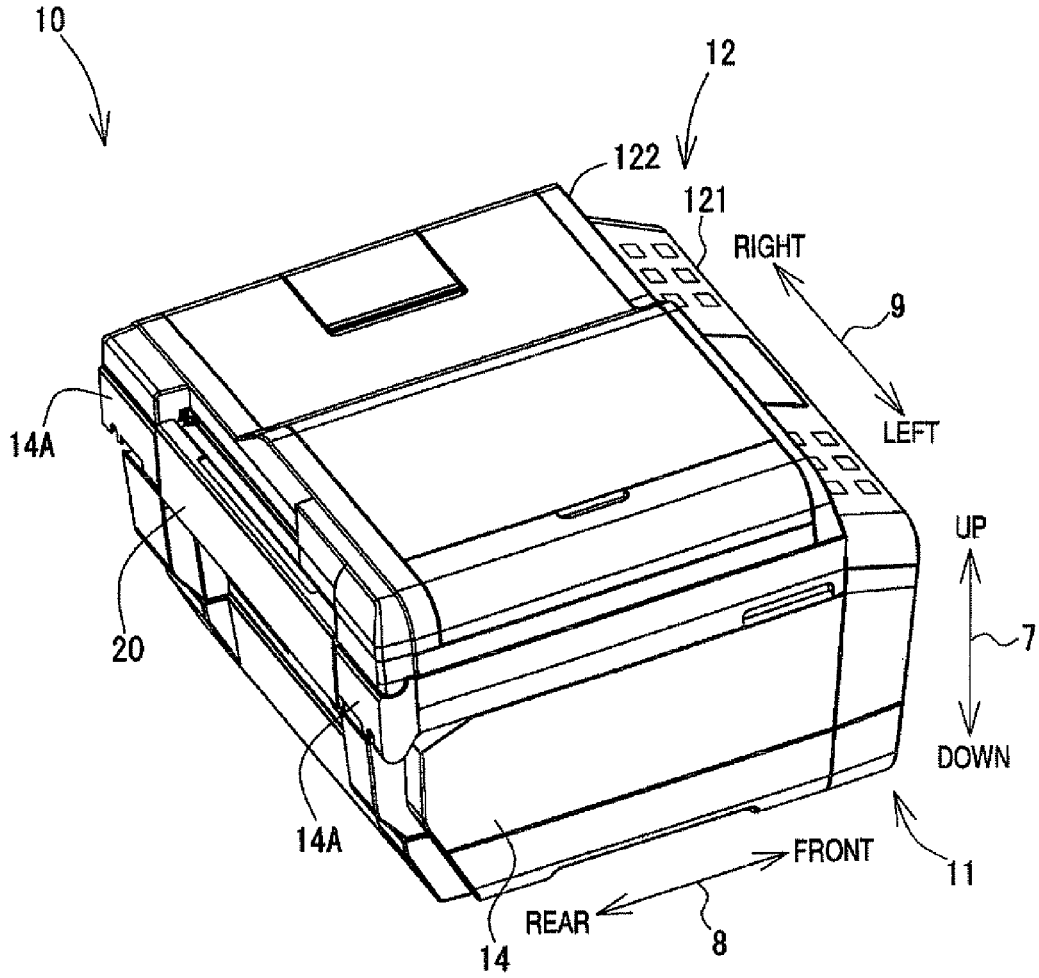
FIG. 1 is a perspective view schematically showing an external configuration of a multi-function peripheral (MFP) in an embodiment according to one or more aspects of the present invention.

In the following description, as depicted in FIG. 1, the directions indicated by the reference numerals "7," "8," and "9" will be defined as an up-to-down direction, a front-to-rear direction, and a left-to-right direction, respectively.

A multi-function peripheral (MFP) 10 of an embodiment includes an image reading unit 12 disposed at an upper side of the MFP 10, an operation panel 121 disposed at a front side of an upper surface of the MFP 10, and an inkjet printing unit 11 disposed at a lower side of the MFP 10. The MFP 10 has various functions such as a facsimile function, a printer function, a scanner function, and a copier function. In the embodiment, the MFP 10 has a single-side image recording function as a printer function. However, the MFP 10 may have a double-side image recording function.

[Configuration of Image Reading Unit]

The image reading unit 12 is disposed above the printing unit 11 and provided with a scanner section 122. The scanner section 122 includes a flatbed scanner (FBS) and an automatic document feeder (ADF). In the embodiment, the scanner section 122 may be configured in any fashion as far as the scanner section 122 reads an image recorded on a document sheet. Therefore, a detailed explanation about a configuration of the scanner section 122 will be omitted.

[Configuration of Operation Panel]

The MFP 10 has the operation panel 121 for operating the printing unit 11 and the scanner section 122 which operation panel is provided at the front side of the upper surface of the MFP 10, i.e., on an upper surface of a front side of the scanner section 122. The operation panel 121 includes various kinds of operation buttons and a liquid crystal display (LCD) unit. The MFP 10 is operated by an instruction input through the operation panel 121.

[Configuration of Printing Unit]

As illustrated in FIG. 1, the printing unit 11 has a casing 14 with an opening formed at each of a front side and a back side thereof. Inside the casing 14, constituent elements of the printing unit 11 are disposed. A container is secured to successively extend from the front opening (not shown) of the printing unit 11 to the inside of the casing 14. A sheet feed cassette 78 is attached inside the container. The sheet feed cassette 78 is configured to be inserted into and ejected from the casing 14 via the front opening. The sheet feed cassette 78 is configured to hold various sizes of recording sheets. In the embodiment, the MFP 10 is configured such that the sheet feed cassette 78 is only attached thereto. However, the MFP 10 may have a plurality of sheet feed cassette 78 attached thereto.

Figure 2:
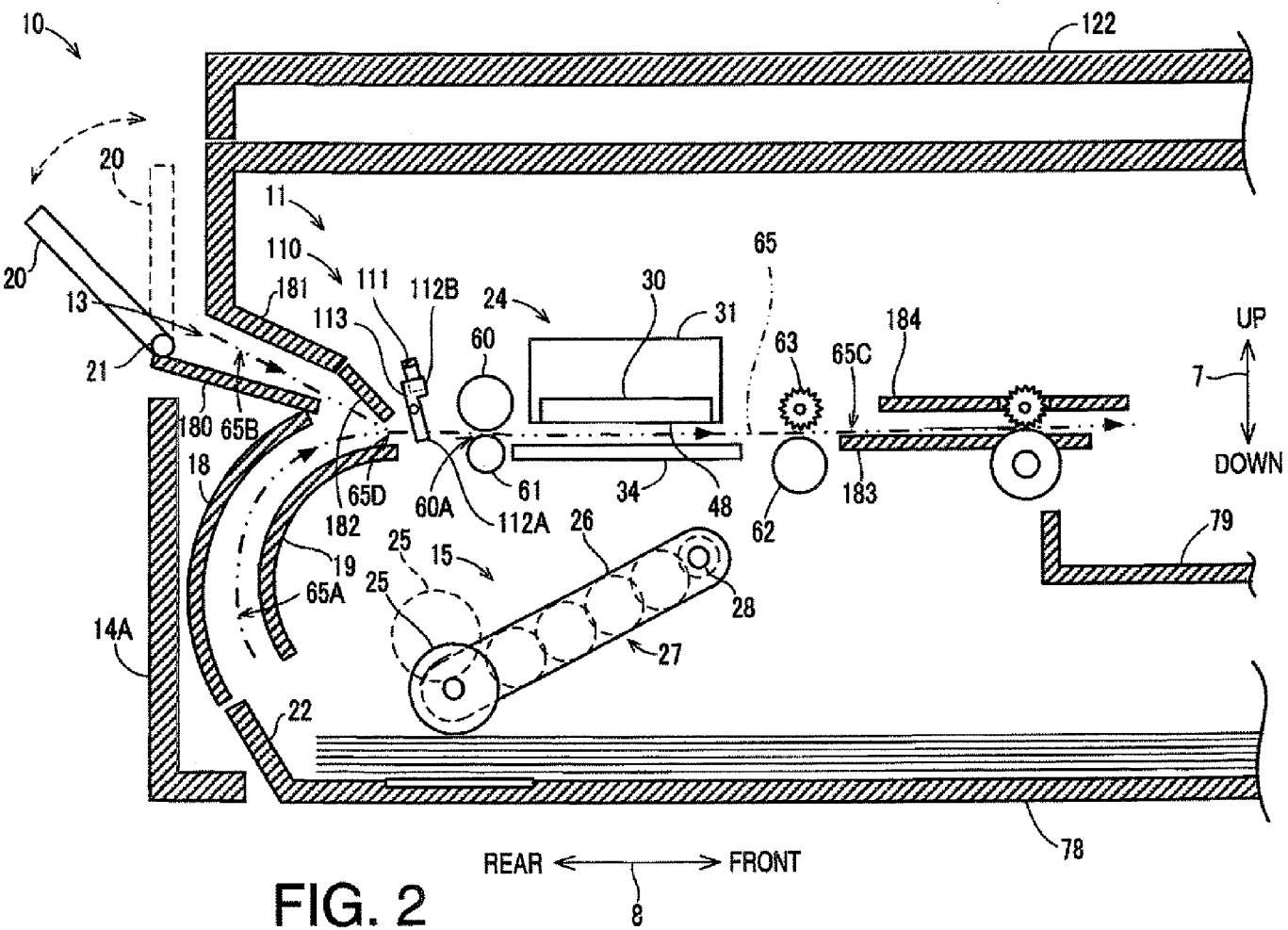
FIG. 2 is a cross-sectional side view schematically showing an internal configuration of a printing unit of the MFP in the embodiment according to one or more aspects of the present invention.

At a back surface 14A of the printing unit 11, a manual sheet feed tray 20 is disposed, in an openable and closable manner, at a height level between the scanner section 122 and the sheet feed cassette 78. As indicated by dashed-line arrows in FIG. 2, the manual sheet feed tray 20 is opened and closed while rotating around a rotation shaft 21. In FIG. 1, the manual sheet feed tray 20 is closed. In FIG. 2, an opened state and a closed state of the manual sheet feed tray 20 are indicated by a solid line and a dashed line, respectively. The manual sheet feed tray 20 is configured to be loaded with various sizes of recording sheets in the opened state. At the back surface of the printing unit 11, a rear opening 13 is provided to face a lower base end of the manual sheet feed tray 20. A recording sheet is inserted by a user forward from the rear opening 13 while being supported by a sheet loading surface of the manual sheet feed tray 20.

Subsequently, referring to FIG. 2, a more detailed explanation will be provided about the configuration of the printing unit 11. In FIG. 2, a front side relative to the sheet feed cassette 78 is not shown. In addition to the sheet feed cassette 78, the printing unit 11 includes a feeder section 15 configured to pick up a recording sheet from the sheet feed cassette 78 and feed the recording sheet, and an inkjet recording section 24 configured to form an image on the recording sheet fed by the feeder section 15 by discharging drops of ink onto the recording sheet.

[Feeding Path]

As depicted in FIG. 2, inside the printing unit 11, a feeding path 65 is formed to extend from the sheet feed cassette 78 and the manual sheet feed tray 20 to a catch tray 79 via the recording section 24. The feeding path 65 includes a curved path 65A formed between a rear end of the sheet feed cassette 78 and the recording section 24, a conveying path 65B formed between a front end of the manual sheet feed tray 20 and a converging point 65D between the curved path 65A and the conveying path 65B, and a sheet ejecting path 65C formed between the recording section 24 and the catch tray 79. It is noted that the catch tray 79 may be configured to be integrated with the sheet feed cassette 78 or to be fixed to a frame of the printing unit 11.

The curved path 65A is bent to extend from around an upper end of a tilted plate separator 22 provided to the sheet feed cassette 78 to the recording section 24. A recording sheet is conveyed backward from the sheet feed cassette 78. Then, the recording sheet is U-turned upward from a downside of the MFP 10 at the back surface side of the MFP 10. Thereafter, the recording sheet is conveyed forward. The curved path 65A is defined by an outside guide member 18 and an inside guide member 19 which are disposed to face each other across a predetermined distance. It is noted that the outside guide member 18, the inside guide member 19, and a below-mentioned first lower guide member 180, first upper guide member 181, second upper guide member 182, lower guide member 183, and third upper guide member 184 extend along the left-to-right direction 9 (see FIG. 1).

The conveying path 65B is formed to linearly extend from the rear opening 13 of the printing unit 11 to the converging point 65D. A recording sheet is inserted so as to contact a nipping point 60A between a first feed roller 60 and a pinch roller 61 via the rear opening 13 and the conveying path 65B. The conveying path 65B is defined by a first lower guide member 180 and a first upper guide member 181 which are disposed to face each other across a predetermined distance. There is a second upper guide member 182 provided downstream relative to the first upper guide member 181 in a feeding direction. It is noted that the feeding direction denotes a direction (indicated by a chain double-dashed line with arrows in FIG. 2) in which a recording sheet is conveyed on the feeding path 65. The second upper guide member 182 is formed to extend from a front end of the first upper guide member 181 to around an upper side of the converging point 65D. Further, the second upper guide member 182 is configured to guide the recording sheet inserted from the manual sheet feed tray 20 to the nipping point 60A via the converging point 65D. In the embodiment, the first lower guide member 180 and the outside guide member 18 are separately formed. However, the first lower guide member 180 and the outside guide member 18 may be formed in an integrated manner.

The sheet ejecting path 65C is defined by a second lower guide member 183 and a third upper guide member 184 that are disposed downstream relative to the recording section 24 in the feeding direction. The sheet ejecting path 65C is configured to guide a recording sheet with an image recorded thereon that is fed by a second feed roller 62 toward a downstream side in the feeding direction while supporting a lower surface of the recording sheet. The third upper guide member 184 is disposed above the second lower guide member 183. The third upper guide member 184 and the second lower guide member 183 are disposed to face each other across such a predetermined distance that a recording sheet passes therebetween.

[Feeder Section]

The feeder section 15 is configured to feed recording sheets placed in the sheet feed cassette 78 to the curved path 65A. The feeder section 15 includes a pickup roller 25, a pickup arm 26, and a feeder driving mechanism 27. The pickup roller 25 is disposed above the sheet feed cassette 78. The pickup roller 25 is configured to pick up a recording sheet placed in the sheet feed cassette 78 and feed the recording sheet to the curved path 65A. The pickup roller 25 is rotatably supported by a leading end of the pickup arm 26. The pickup roller 25 is rotated by a driving force that is transmitted by a motor for sheet feeding via the feeder driving mechanism 27. The feeder driving mechanism 27 includes a plurality of gears that are rotatably supported by the pickup arm 26 and arranged substantially in a linear manner along a longitudinal direction of the pickup arm 26. The pickup roller 25 is configured to rotate around a rotation shaft 28 and establish pressure-contact with a top recording sheet placed in the sheet feed cassette 78.

[Registration Sensor]

A registration sensor 110 is disposed on the curved path 65A. The registration sensor 110 is configured to detect a leading end of a recording sheet which is fed on the curved path 65A from the sheet feed cassette 78 or inserted from the manual sheet feed tray 20 via the conveying path 6513. For instance, the registration sensor 110 includes a rotational body having detectors 112A and 11213, and an optical sensor 111 such as a photo-interrupter having a light emitter (e.g., a light emitting diode) and a light receiver (e.g., a photodiode) configured to receive light from the light emitter. The rotational body is configured to rotate around a rotation shaft 113. The detector 112A protrudes from the rotation shaft 113 into the curved path 65A. In a state where an external force is not applied to the rotational body 112, the detector 112B is placed so as to block an optical path that extends from the light emitter to the light receiver of the optical sensor 111.

[Recording Section]

Figure 3:
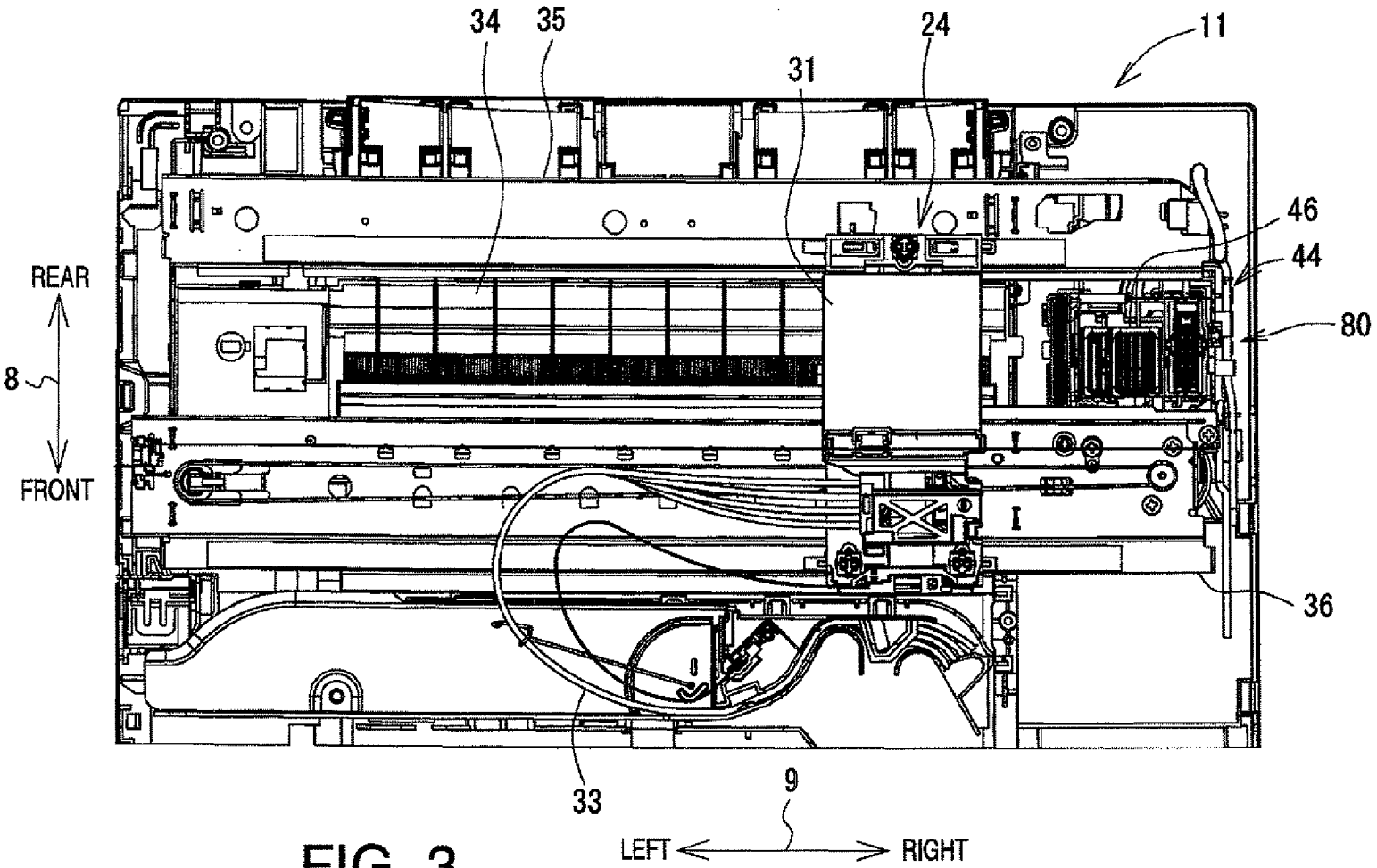
FIG. 3 is a cross-sectional partial top view showing the internal configuration of the printing unit of the MFP in the embodiment according to one or more aspects of the present invention.

The recording section 24 is disposed above the sheet feed cassette 78. As shown in FIGS. 2 and 3, the recording section 24 includes a carriage 31 that is mounted with a recording head 30 and configured to reciprocate in a main scanning direction. To the recording head 30, ink of each color of cyan (C), magenta (M), yellow (Y), and black (Bk) is supplied from an ink cartridge (not shown) through an ink tube 33. The head carriage 31 reciprocates along guide rails 35 and 36 extending in the main scanning direction. Thereby, the recording head 30 is scanned relative to a recording sheet, so as to record an image on the recording sheet that is conveyed on a platen 34 disposed under the recording section 24.

As illustrated in FIG. 2, the recording head 30 is exposed to face down at a lower side of the carriage 31. The recording head 30A includes a plurality of nozzles (not shown) disposed on a nozzle surface 48 thereof. Each of the nozzles is provided for a corresponding one of the ink colors C, M, Y, and Bk. A micro-drop of ink of a corresponding color is discharged from each nozzle. There are four exhaust holes (not shown), each of which is provided on a left or right side of the nozzles for a separate one of the ink colors C, M, Y, and Bk. Each exhaust hole communicates with an air bubble storage room (not shown) provided inside the recording head 30.

Between a terminal end of the curved path 65A and the recording section 24, the first feed roller 60 and the pinch roller 61 are disposed to be paired. The pinch roller 61 is disposed beneath the first feed roller 60. The pinch roller 61 is urged by an elastic member such as a spring (not shown) to come into pressure-contact with a roller surface of the first feed roller 60. The first feed roller 60 and the pinch roller 61 pinch a recording sheet carried on the curved path 65A and the conveying path 65B while feeding the recording sheet onto the platen 34. Further, between the recording section 24 and a start end of the sheet ejecting path 65C, the second feed roller 62 and a spur roller 63 are disposed to be paired. The second feed roller 62 and the spur roller 63 pinch a recording sheet with an image recorded thereon while feeding the recording sheet downstream in the feeding direction (toward the catch tray 79).

Figure 8:
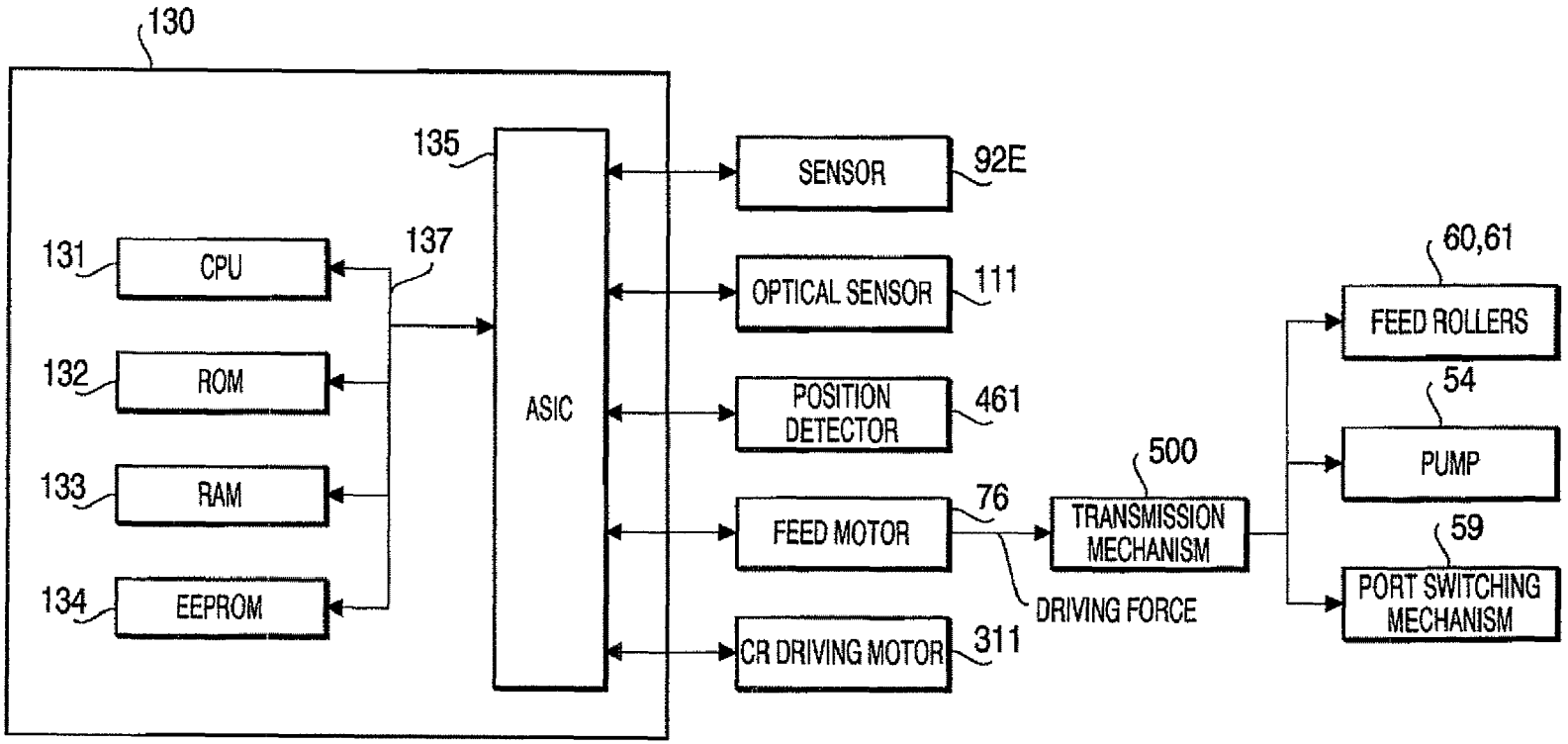
FIG. 8 is a block diagram schematically showing a configuration of a controller connected with other elements in the embodiment according to one or more aspects of the present invention.

The first feed roller 60 and the second feed roller 62 are driven to rotate when a driving force is transmitted thereto by a feed motor 76 (see FIG. 8) via a transmission mechanism 500 (see FIG. 8). The first feed roller 60 and the second feed roller 62 are intermittently driven in an image recording operation. Therefore, the image recording operation is performed while a recording sheet is being conveyed by predetermined linefeed widths.

[Transmission Mechanism]

The transmission mechanism 500 is provided with a planet gear and configured to transmit, to a below-mentioned pump 54, a rotational driving force of the feed motor 76 rotating in a first one of forward and backward directions. Further, the transmission mechanism 500 is configured to transmit, to a below-mentioned port switching mechanism 59, a rotational driving force of the feed motor 76 rotating in a second one of the forward and backward directions. It is noted that the first feed roller 60 and the second feed roller 62 are rotated by the feed motor 76, which is rotating in the first one of the forward and backward directions, in such a direction as to feed a recording sheet downstream in the feeding direction. Further, the first feed roller 60 and the second feed roller 62 are rotated by the feed motor 76, which is rotating in the second one of the forward and backward directions, in such a direction as to feed a recording sheet upstream in the feeding direction.

[Maintenance Unit]

Figure 4:
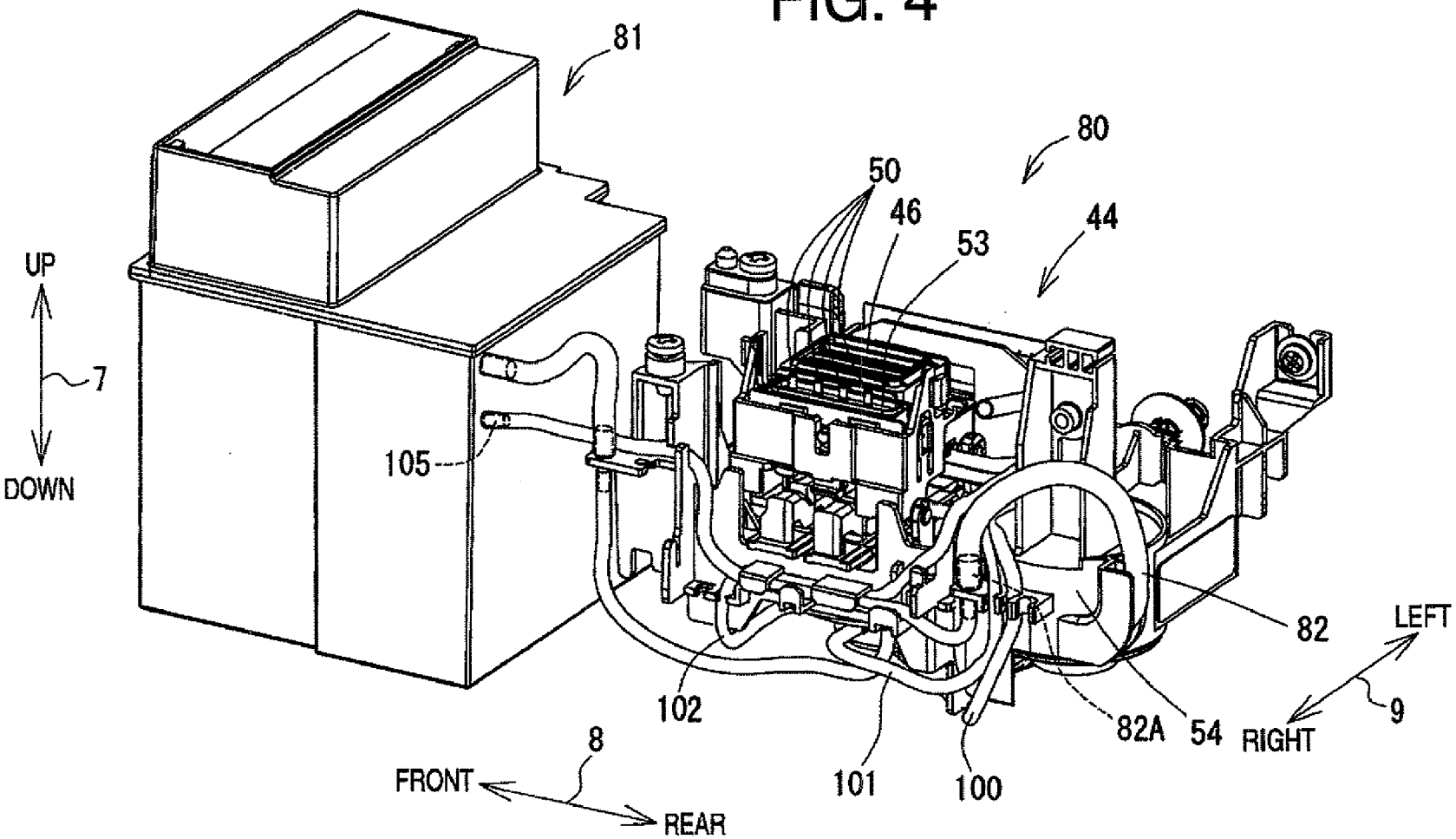
FIG. 4 is a perspective view of a maintenance unit in the embodiment according to one or more aspects of the present invention.

As shown in FIG. 3, a maintenance unit 80 is disposed in an area on a right side of the platen 34 in the left-to-right direction 9, which area a recording sheet does not pass through. As depicted in FIG. 4, the maintenance unit 80 includes a purge mechanism 44 and a waste liquid tank 81. It is noted that the waste liquid tank 81 is not shown in FIG. 3 as being disposed under the guide rail 36.

Figure 5A:
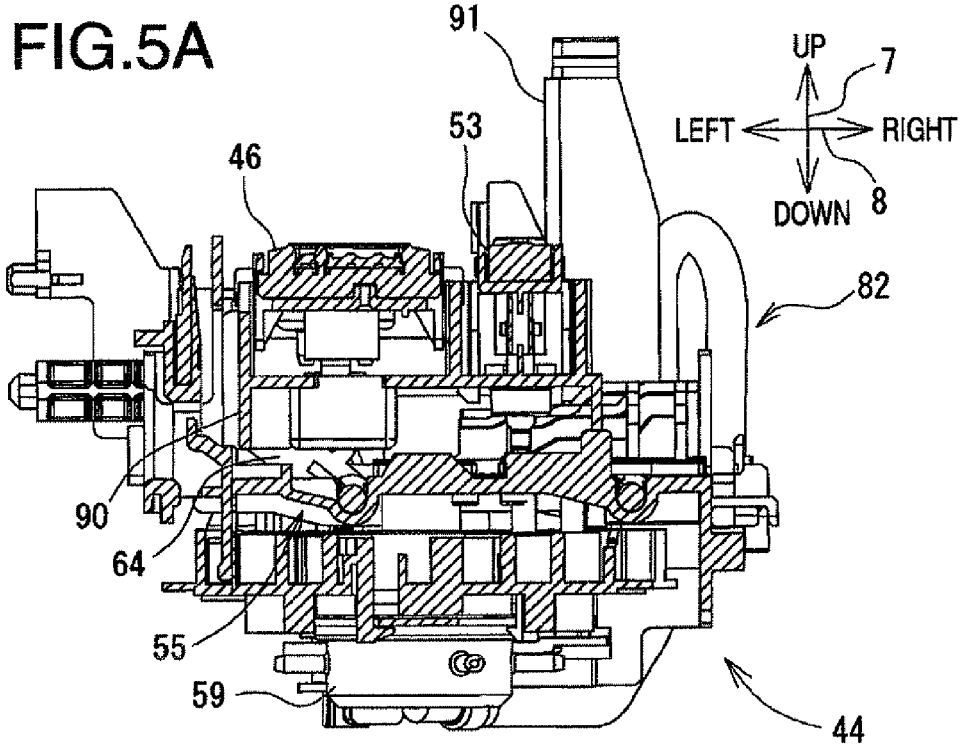
FIG. 5A is a cross-sectional front view of a purge mechanism in a state where a cap is not lifted up in the embodiment according to one or more aspects of the present invention.
Figure 5B:
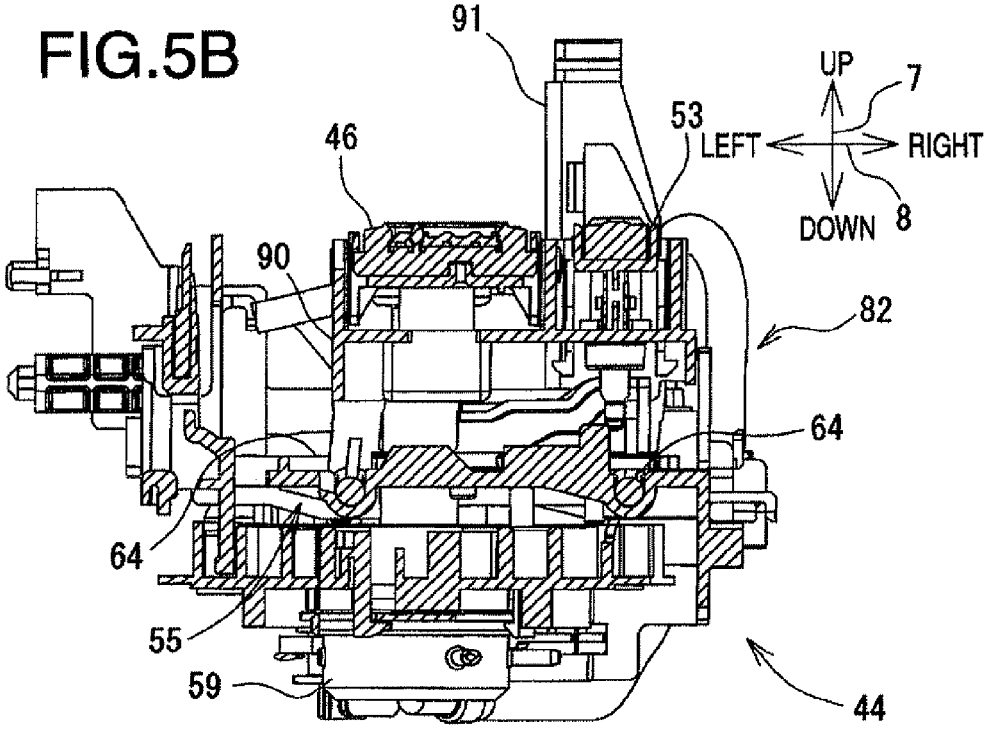
FIG. 5B is a cross-sectional front view of the purge mechanism in a state where the cap is lifted up in the embodiment according to one or more aspects of the present invention.

The purge mechanism 44 is configured to suck and remove air bubbles and foreign material from the nozzles of the recording head 30. As shown in FIGS. 4, 5A, and 5B, the purge mechanism 44 includes a cap 46 that covers the nozzles of the recording head 30, an exhaust cap 53 that covers the exhaust holes of the recording head 30, a pump 54 that is connected with the cap 46 or the exhaust cap 53 and configured to perform a suction operation, a lift-up mechanism 55 (see FIGS. 5A and 5B) that moves the cap 46 and the exhaust cap 53 into contact with or apart from the recording head 30, and a pump tube 82 that connects the pump 54 with the waste liquid tank 81.

The cap 46 is formed from rubber. The cap 46 is brought into close contact with the nozzle surface (see FIG. 2) by the lift-up mechanism 55, forms a space between the nozzle surface 48 and the cap 46, and surrounds the nozzles. Inside the cap 46, there are two spaces sectioned separately for color-ink (C, M, and Y) nozzles and the black-ink (3*k*) nozzle. Namely, one of the spaces is formed between the cap 46 and a part of the nozzle surface 48 corresponding to the color-ink nozzles while the other thereof is formed between the cap 46 and a part of the nozzle surface 48 corresponding to the black-ink nozzle. An intake hole (not shown) is formed at a bottom of each space of the cap 46, and each intake hole is connected with the pump 54 via the port switching mechanism 59. It is noted that the port switching mechanism 59 will be described below.

The exhaust cap 53 is formed from rubber. The exhaust cap 53 is configured to contact closely with the nozzle surface 48 (see FIG. 2) and surround the exhaust holes of the recording head 30. Inside the exhaust cap 53, there are four pushrods 50 provided to stand upward in the vertical direction, which pushrods correspond separately to the ink colors C, M, Y, and Bk. When the pushrods 50 are inserted into the exhaust holes, respectively, a return check valve provided to each exhaust hole is released. An intake hole (not shown) is formed at a bottom of the exhaust cap 53, and connected with the pump 54 via the port switching mechanism 59.

The pump 54 is a rotary tube pump. In the embodiment, the pump 54 includes a casing having an inner wall surface, and a roller configured to move while rotating along the inner wall surface. The pump tube 82 is disposed between the roller and the inner wall surface. When the roller is driven, the pump tube 82 is compressed such that ink inside the pump tube 82 is pushed out from an upstream side (the cap 46 and the intake hole) to a downstream side (the waste liquid tank 81).

As illustrated in FIG. 5A, the lift-up mechanism 55 includes a pair of isometric links 64 disposed at each side thereof in the left-to-right direction. When the isometric links 64 are turned, a holder 90 is translated between a waiting position and a close-contact position. In FIG. 5A, the holder 90 is in the waiting position. Meanwhile, in FIG. 5B, the holder 90 is in the close-contact position. The holder 90 includes a contact lever 91 configured to protrude upward in the vertical direction. When the carriage 31 pushes the contact lever 91 rightward in FIGS. 5A and 5B, the holder 90 is moved to the close-contact position. The cap 46 and the exhaust cap 53 are mounted on the holder 90. When the holder 90 is moved to the close-contact position, the cap 46 and the exhaust cap 53 are brought into close contact with circumferences of the nozzles of the recording head 30 and circumferences of the exhaust holes of the recording head 30, respectively (a first position). Meanwhile, when the holder 90 is moved to the waiting position, the cap 46 and the exhaust cap 53 are taken away from the recording head 30 (a second position). It is noted that the carriage 31 is moved by a motor (e.g., a carriage (CR) driving motor 311, see FIG. 8). Further, the cap 46 may be moved by any mechanism other than the lift-up mechanism 55 as far as the cap 46 can be moved between the first position and the second position.

Near the cap 46, a position detector 461 (see FIG. 8) is disposed to detect the position of the cap 46. For instance, the position detector 461 may include a slider configured to slide up and down depending on the position of the cap 46, and an optical sensor such as a photo-interrupter having a light emitter (e.g., a light emitting diode) and a light receiver (e.g., a phototransistor). When the cap 46 is in the first position, the slider is located to block an optical path extending from the light emitter to the light receiver. Namely, based on whether the optical path is blocked or not, the position of the cap 46 can be detected.

[Port Switching Mechanism]

Figure 6:
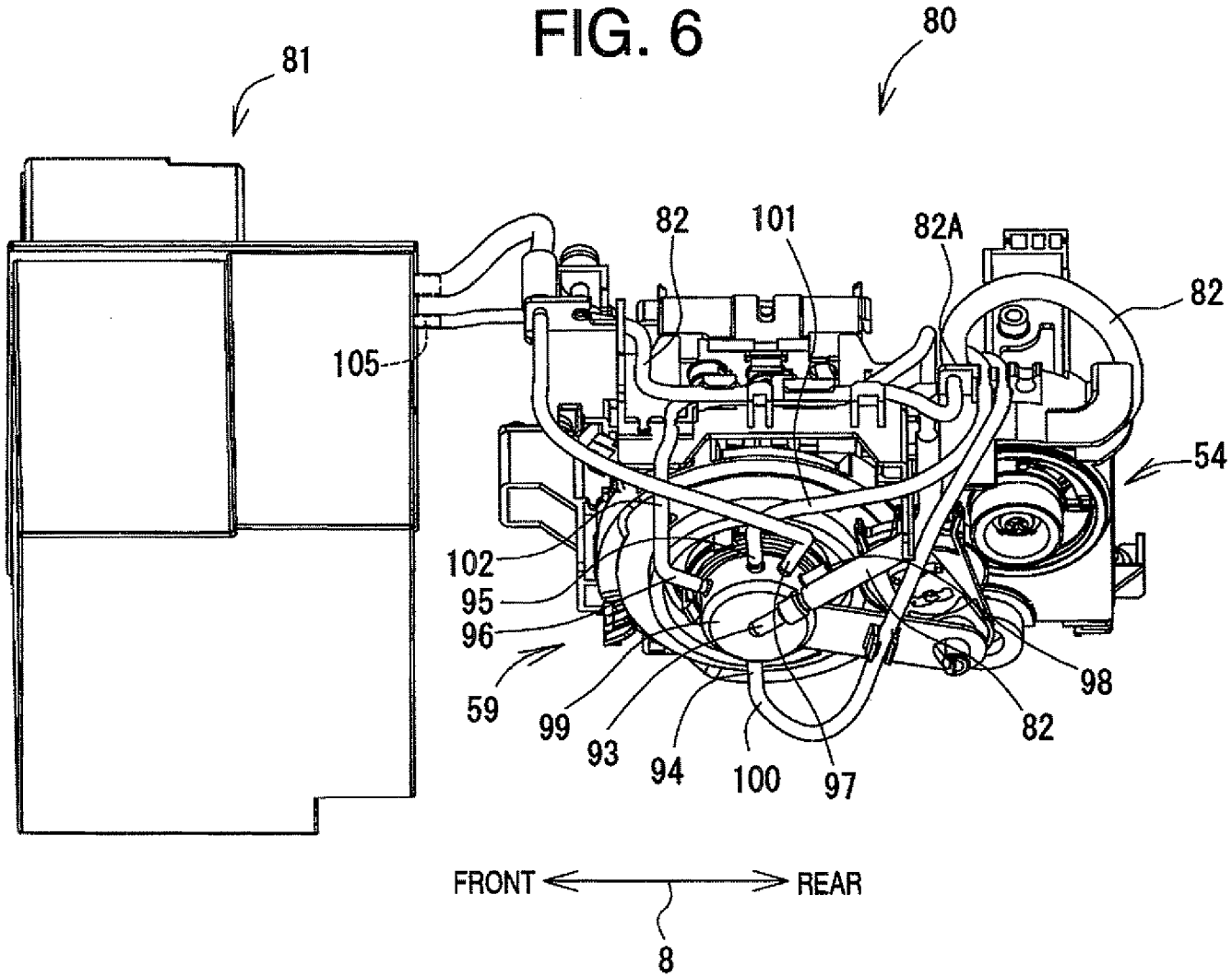
FIG. 6 is a perspective view of the maintenance unit to show an external configuration of a port switching mechanism in the embodiment according to one or more aspects of the present invention.

The port switching mechanism 59 (see FIGS. 5 and 6) is configured to switch a state established between the cap 46 (the exhaust cap 53) and the pump 54, between a connected state and an unconnected state. As depicted in FIGS. 6 and 7, the port switching mechanism 59 includes a cover 99 having six pots 93 to 98, and a disk-shaped switching member 92 disposed inside the cover 99. The switching member 92 is rotated by the feed motor (see FIG. 8) to control connection among the ports 93 to 98 as described later. The cover 99 is made of resin and formed in a shape of a cylinder having a bottom wall. The cover 99 has the inlet port 93 formed at the center of the bottom wall of the cover 99. The inlet port 93 is connected with the pump tube 82. The pump tube 82 is connected with a tube joint 105 of the waste liquid tank 81 via the pump 54 and a tube joint 82A.

The other five ports 94 to 98 are disposed circumferentially on a side wall of the cover 99 at intervals of a predetermined distance. The exhaust port 94 communicates with the exhaust cap 53 (see FIG. 4) via a tube 100. The Bk port 95 communicates with the cap 46 (see FIG. 4) via a tube 101. Specifically, the Bk port 95 communicates with the space for the black-ink nozzle that is formed between the cap 46 and the nozzle surface 48. The Co port 96 communicates with the cap 46 (see FIG. 4) via a tube 102. Specifically, the Co port 96 communicates with the space for the color-ink nozzles that is formed between the cap 46 and the nozzle surface 48. The air ports 97 and 98 are open to atmospheric air.

Ink, which is sucked by the maintenance unit 80 from the recording head 30, is conveyed to the waste liquid tank 81 in accordance with the following procedure. Hereinafter, an explanation will be provided about the procedure of an ink suction process with reference to FIG. 7.

When the carriage 31 is moved in a sliding manner and thereby the contact lever 91 is pressed rightward, the holder 90 is moved to the close-contact position. Namely, the cap 46 is brought into close contact with the nozzle surface 48 by the lift-up mechanism 55. The switching member 92 is driven, and the inlet port 93 is connected with none of the other ports 94 to 98 (see FIG. 7A). In other words, the space formed between the cap 46 and the nozzle surface 48 is cut off from the atmospheric air and does not communicate with the pump 54 (a second state). In this state, the pump 54 is driven, and the inside of the pump tube 82 is depressurized. The switching member 92 is driven, and the inlet port 93 comes to communicate with the Bk port 95 (see FIG. 7B). Namely, the portion, of the space formed between the cap 46 and the nozzle surface 48, which corresponds to the black-ink nozzle, is connected to the pump 54 (a first state). Consequently, black ink, which is stored in the portion of the space formed between the cap 46 and the nozzle surface 48 that corresponds to the black-ink nozzle, is sucked at a burst toward the pump 54. The sucked ink is stored into the waste liquid tank 81 via the tube pump 82.

Figure 7A:
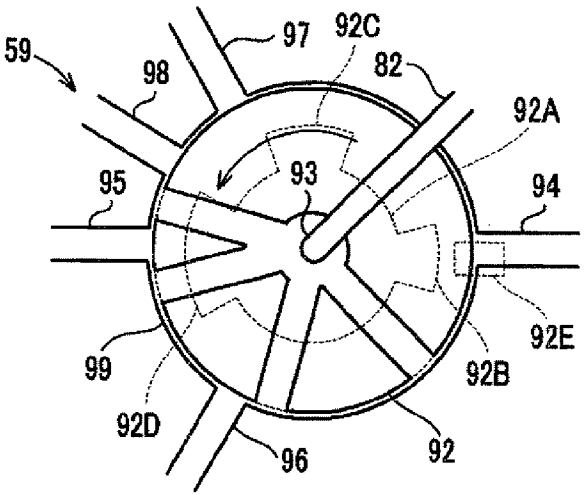
FIG. 7A is a top view of the port switching mechanism in a state where an inlet port does not communicate with any other ports in the embodiment according to one or more aspects of the present invention.
Figure 7B:
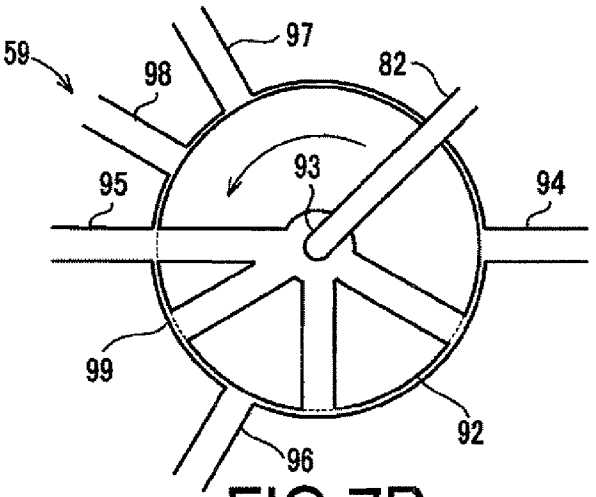
FIG. 7B is a top view of the port switching mechanism in a state where the inlet port communicates with a Bk port in the embodiment according to one or more aspects of the present invention.
Figure 7C:
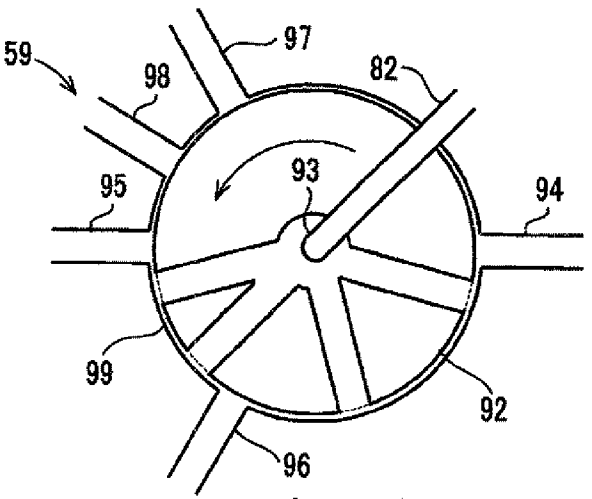
FIG. 7C is a top view of the port switching mechanism in a state where the inlet port does not communicate with any other ports in the embodiment according to one or more aspects of the present invention.
Figure 7D:
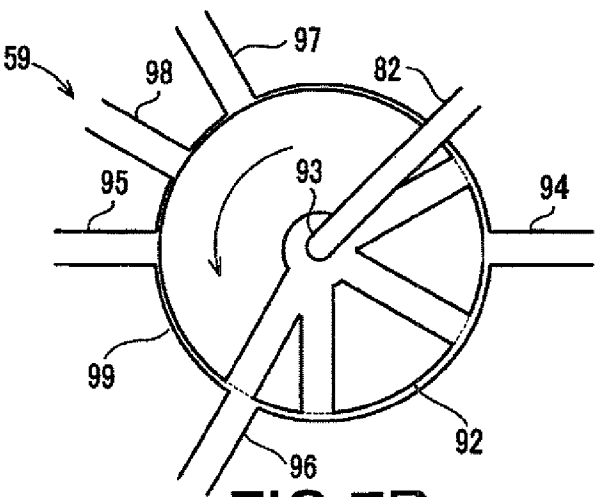
FIG. 7D is a top view of the port switching mechanism in a state where the inlet port communicates with a Co port in the embodiment according to one or more aspects of the present invention.

The switching member 92 is driven, and the inlet port 93 comes to communicate with none of the other ports 94 to 98 (see FIG. 7C). Namely, the space formed between the cap 46 and the nozzle surface 48 is cut off from the atmospheric air, and does not communicate with the pump 54 (the second state). In this state, the pump 54 is driven, and the inside of the pump tube 82 is depressurized. The switching member 92 is driven, and the inlet port 93 comes to communicate with the Co port 96 (see FIG. 7D). Namely, the portion, of the space formed between the cap 46 and the nozzle surface 48, which corresponds to the color-ink nozzles, is connected with the pump 54 (the first state). Consequently, color ink, which is stored in the portion of the space formed between the cap 46 and the nozzle surface 48 that corresponds to the color-ink nozzles, is sucked at a burst toward the pump 54. The sucked ink is stored into the waste liquid tank 81 via the tube pump 82. Thereafter, when the carriage 31 is set apart from the contact lever 91 in a sliding manner, the cap is restored to the second position by the lift-up mechanism 55.

As indicated by a dashed line in FIG. 7A, above or under the switching member 92, a rotational body 92A configured to rotate integrally with the switching member 92 is provided. The rotational body 92A includes protruding sections 92B, 92C, and 92D that protrude outward in a radial direction. The protruding sections 92B, 92C, and 92D are disposed in respective positions of different phases in a rotational direction of the rotational body 92A. The protruding sections 92B, 92C, and 92D are placed to be apart from each other by a predetermined rotation angle. Further, a sensor 92E is disposed to face an outer circumference of the rotational body 92A. When facing one of the protruding sections 92B, 92C, and 92D, the sensor 92E outputs an electric signal "ON." When not facing any of the protruding sections 92B, 92C, and 92D, the sensor 92E outputs an electric signal "OFF." Based on a periodical change of the output (ON/OFF) from the sensor 92E, it is possible to grasp a rotational phase of the switching member 92.

[Controller]

Hereinafter, referring to FIG. 8, a configuration of a controller 130 of the MFP 10 will be described. When the controller 130 takes nip control in accordance with a below-mentioned flowchart, the controller 130 can establish a control mechanism according to aspects of the present invention.

The controller 130 is adapted to control overall operations of the MFP 10. The controller 130 is configured as a microcomputer that includes a CPU 131, a ROM 132, a RAM 133, an EEPROM 134, and an ASIC 135. The CPU 131, the ROM 132, the RAM 133, the EEPROM 134, and the ASIC 135 are interconnected via an internal bus.

The ROM 132 stores programs for the CPU 131 to control various operations of the MFP 10 and a program for executing a below-mentioned state determining process. The RAM 133 is employed as a storage area for temporarily storing data or signals used for the CPU 131 to execute the aforementioned programs, or as a work area for data processing by the CPU 131. The EEPROM 134 stores settings and flags that are to be held even after the MFP 10 is powered off.

The ASIC 135 is connected with various elements such as the optical sensor 111 and the feed motor 76. The ASIC 135 has a drive circuit incorporated therein, which is configured to control the feed motor 76. When a driving signal for rotating the feed motor 76 is transmitted by the CPU 131 to the drive circuit, a drive current responsive to the drive signal is transmitted by the drive circuit to the feed motor 76. Thereby, the feed motor 76 is rotated at a predetermined rotational speed in one of a forward direction and a backward direction. By the rotation of the feed motor 76, the switching member 92, the first feed roller 60, and the second feed roller 62 are rotated.

The optical sensor 111 outputs an analog electric signal (an electric voltage signal or an electric current signal) responsive to an intensity of light received by the light receiver. The output signal is transmitted to the controller 130, and the controller 130 determines whether an electric level (an electric voltage value or an electric current value) of the signal is equal to or higher than a predetermined threshold. When the signal is equal to or higher than the predetermined threshold, the signal is determined as a HIGH-level signal. When the signal is lower than the predetermined threshold, the signal is determined as a LOW-level signal.

[Nip Control Process]

In the printing unit 11 configured as above, the controller 130 performs a nip control process to nip a recording sheet, which is in contact with the nipping point 60A, between the first feed roller 60 and the pinch roller 61. Hereinafter, referring to a flowchart shown in FIG. 9, the procedure of the nip control process will be described. The nip control process is performed, e.g., when the registration sensor 110 detects a recording sheet in a standby state where the pickup roller 25 or the first feed roller 60 is not driven (the controller 130 does not issue a sheet feeding command to feed a recording sheet from the sheet feed cassette 78 or a print command). In the following description, for the sake of simpler explanation, it is assumed that when the feed motor 76 is rotated in the forward direction, a recording sheet is fed downstream in the feeding direction, and the purge mechanism 44 sucks ink from the nozzles of the recording head 30. Further, it is assumed that when the feed motor 76 is rotated in the backward direction, a recording sheet is fed upstream in the feeding direction. and the port switching mechanism 59 sets the cap 46 and the pump 54 to the connected state or the unconnected state.

In the standby state, when the user of the MFP 10 places a recording sheet on the manual sheet feed tray while inserting the recording sheet until the recording sheet contacts the nipping point 60A, a leading end of the recording sheet is detected by the registration sensor 110 (S10).

After a leading end of the recording sheet is detected by the registration sensor 110 in S10, the controller 130 waits for a predetermined time period (e.g., two seconds) before performing a subsequent step (S20). Thereafter, when determining that the MFP 10 has a skew correction function for correcting skew of the recording sheet (S30: Yes), the controller 130 performs skew correction for the recording sheet inserted (S40). Specifically, the controller 130 controls the feed motor 76 to rotate in the backward direction by a predetermined phase such that the recording sheet, which is inserted to contact the nipping point 60A with a skew angle, recedes from the nipping point 60A. Thereafter, the recording sheet contacts the nipping point 60A in a state where the skew angle is corrected owing to the weight of the recording sheet.

Further, when the feed motor 76 is rotated in the backward direction, the port switching mechanism 59 is driven. When the port switching mechanism 59 is driven, the inlet port 93 is set to a state where the inlet port 93 does not communicate with any of the other ports 94 to 98 (S50).

When determining in S30 that the MFP 10 does not have a skew correction function for correcting skew of the recording sheet (S30: No), the controller 130 determines whether the switching member 92 of the port switching mechanism 59 is in the second state, through detection using the rotational body 92A and the sensor 92E (S60). When determining that the switching member 92 is not in the second state (S60: No), the controller 130 determines whether the cap 46 is in the second position where the cap 46 is apart from the recording head 30, through detection using the position detector 461 (S70). When determining that the cap 46 is not in the second position (S70: No), the controller 130 sets the port switching mechanism 59 to the second state (S50).

When determining that the switching member 92 is in the second state (S60: Yes) or that the cap 46 is in the second position (S70: Yes), or after setting the port switching mechanism 59 to the second state (S50), the controller 130 performs a nipping operation (S80). Specifically, the controller 130 controls the feed motor 76 to rotate in the forward direction by a predetermined phase, such that the recording sheet, which contacts the nipping point 60A, is nipped between the first feed roller 60 and the pinch roller 61 by an amount corresponding to the rotation of the feed roller 76 in the forward direction.

After that, the controller 130 informs the user of information that the recording sheet placed on the manual sheet feeding tray 20 is normally nipped, i.e., normally fed (S90). For instance, a message about the information is displayed on the LCD unit of the operation panel 121.

[Effects]

The recording sheet placed on the manual sheet feed tray 20 is detected by the registration sensor 110. When confirming the detection, the controller 130 drives the feed motor 76 to rotate in the second one of the forward direction and the backward direction, such that the port switching mechanism 59 is switched to the second state (where the inlet port 93 does not communicate with any of the other ports 94 to 98). Thereafter, the controller 130 drives the feed motor 76 to rotate in the first one of the forward direction and the backward direction, such that the pump 54 is driven. Even though the pump 54 is driven, since the inlet port 76 does not communicate with any of the other ports 94 to 98, the pump 54 cannot suck any ink. Meanwhile, the first feed roller 60 and the pinch roller 61 are driven by the driving force transmitted by the feed motor 76 rotating in the first one of the forward direction and the backward direction, so as to nip the recording sheet (in contact with the nipping point 60A between the first feed roller 60 and the pinch roller 61) between the first feed roller 60 and the pinch roller 61.

When the cap 46 is in the first position, the nozzles are covered and sealed by the cap 46. Therefore, when the pump 54 is driven, ink is sucked. Meanwhile, when the cap 46 is in the second position, the nozzles are not sealed. Therefore, even when the pump 54 is driven, ink is not sucked. Accordingly, the controller 130 switches the state of the port switching mechanism 59 when the cap 46 is in the first position.

In the case where the port switching mechanism 59 is in the first position when the driving force is transmitted by the feed motor 76 to the pump 54, ink is sucked from the nozzles as the cap 46 communicates with the pump 54. Meanwhile, in the case where the port switching mechanism 59 is in the second position when the driving force is transmitted by the feed motor 76 to the pump 54, ink is not sucked from the nozzles as the cap 46 does not communicate with the pump 54.

When the recording sheet placed on the manual sheet feed tray 20 is detected by the registration sensor 110, and the cap 46 is in the first position, the controller 130 drives the feed motor 76 to rotate in the second one of the forward direction and the backward direction, such that the port switching mechanism 59 is switched to the second state. Thereafter, the controller 130 drives the feed motor 76 to rotate in the first one of the forward direction and the backward direction. However, since the port switching mechanism 59 is switched to the second state, ink is not sucked from the recording head 30. Meanwhile, the first feed roller 60 and the pinch roller 61 are driven by the driving force transmitted by the feed motor 76 rotating in the first one of the forward direction and the backward direction, so as to nip the recording sheet (in contact with the nipping point 60A between the first feed roller 60 and the pinch roller 61) between the first feed roller 60 and the pinch roller 61. According to the aforementioned configuration, it is possible to nip the recording sheet between the first feed roller 60 and the pinch roller 61 while preventing ink from being wastefully consumed.

When detecting that the port switching mechanism 59 is in the second state, using the rotational body 92A and the sensor 92E, the controller 130 does not drive the feed motor 76 to switch the port switching mechanism 59 from the first state to the second state. Namely, the controller 130 drives the feed roller 76 to rotate in the first one of the forward and backward directions without rotating the feed roller 76 in the second one of the forward and backward directions. Hence, it is possible to expedite an operation of nipping the recording sheet between the first feed roller 60 and the pinch roller 61.

When the position detector 461 detects that the cap 46 is in the second position, the cap 46 is apart from the recording head 30. Therefore, even though the pump 54 is driven when the port switching mechanism 59 is in the first state, ink is not sucked from the nozzles. Namely, even though the port switching mechanism 59 is not switched to the second state, it is possible to avoid wasteful consumption of ink. Thus, the controller 130 does not drive the feed motor 76 to switch the port switching mechanism 59 to the second state. In other words, the controller 130 drive the feed motor 76 to rotate in the first one of the forward and backward directions without rotating the feed motor 76 in the second one of the forward and backward directions. Accordingly, it is possible to expedite an operation of nipping the recording sheet between the first feed roller 60 and the pinch roller 61.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

In the aforementioned embodiment, the transmission mechanism 500 is configured to transmit a driving force to the pump 54 and the port switching mechanism 59 (see FIG. 8). However, the transmission mechanism 500 may be configured to transmit a driving force to the pickup roller 25 and the pickup arm 26.

In this modification, the driving force of the feed motor 76 is transmitted to the pickup arm 26. The pickup arm 26 is rotated around the rotation shaft 28 by a rotational driving force that is transmitted by the feed motor 76 rotating in the second one of the forward and backward directions. Consequently, the pickup arm 26 is switched between a first state where the pickup roller 25 contacts a recording sheet placed in the sheet feed cassette 78 and a second state where the pickup roller 25 is apart from the recording sheet.

Further, an arm state detector (not shown) configured to detect the state of the pickup arm 26 may be provided. The arm state detector may be configured in the same manner as the aforementioned position detector 461. In the aforementioned embodiment, the sensor 92E detects whether the port switching mechanism 59 is in the second state. However, in the modification, the arm state detector may detect whether the pickup arm 26 is in the second state. Namely, the arm state detector of the modification may serve as the sensor 92E of the aforementioned embodiment.

Figure 9:
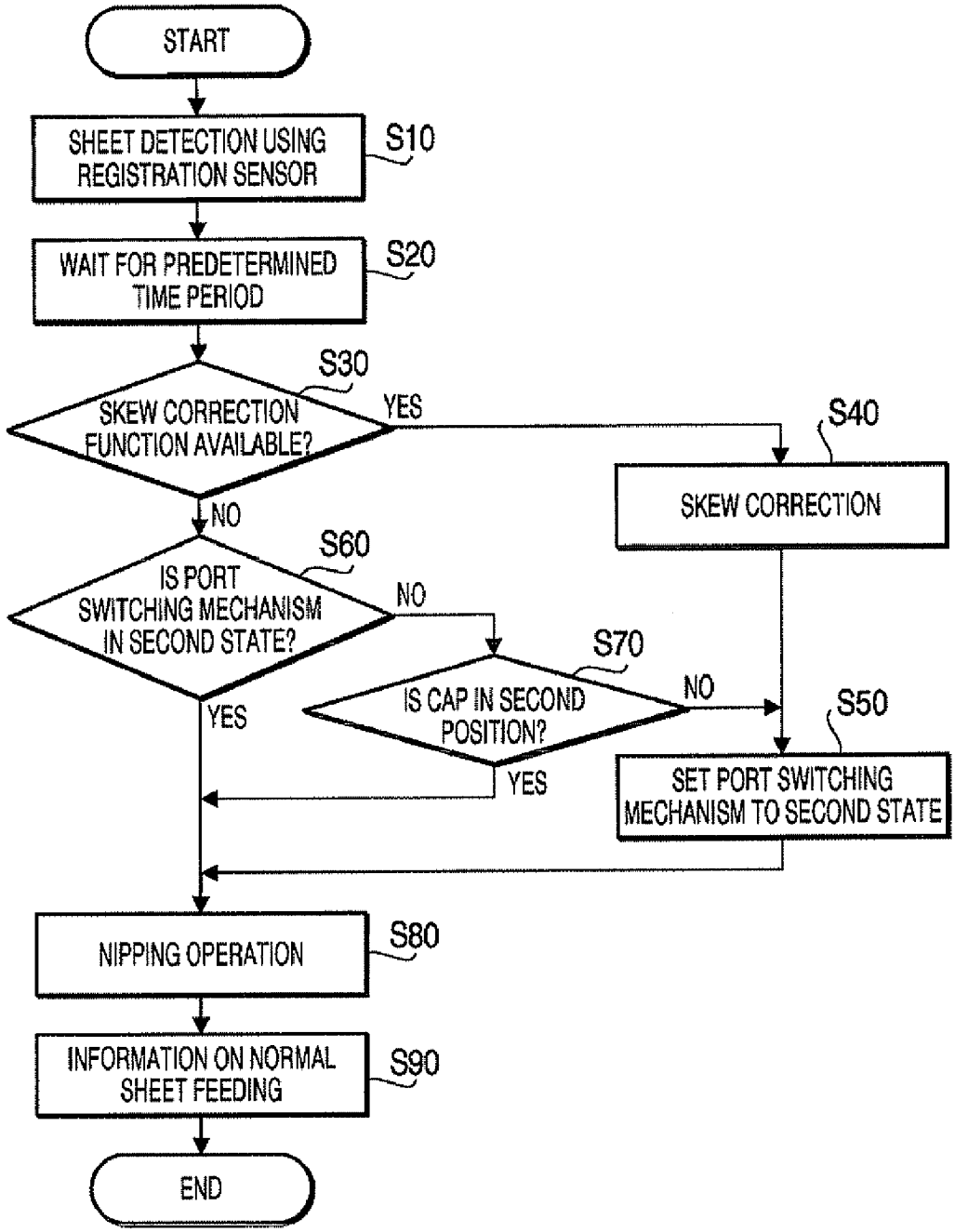
FIG. 9 is a flowchart showing a procedure of a nip control process to be executed by the controller in the embodiment according to one or more aspects of the present invention.
Figure 10:
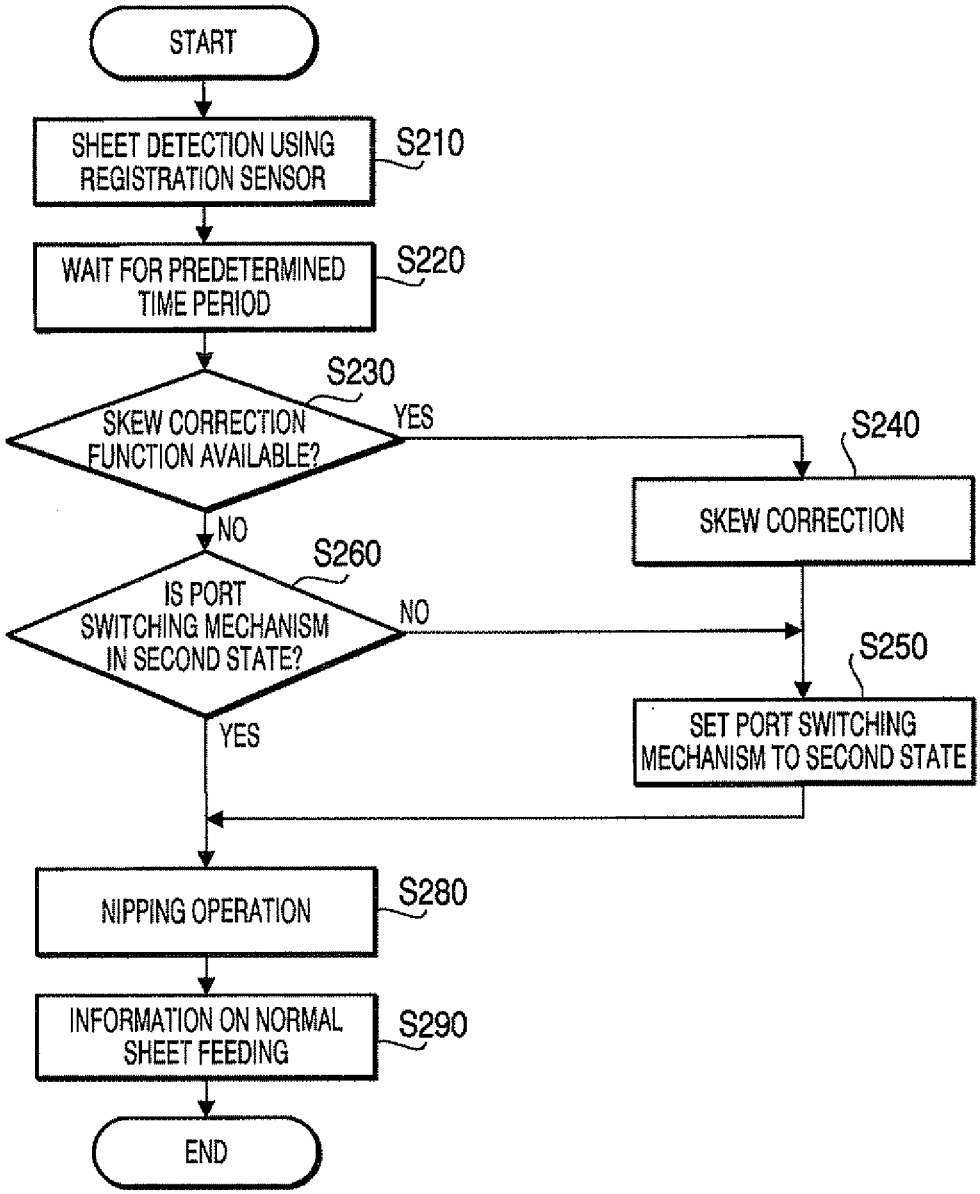
FIG. 10 is a flowchart showing a procedure of a nip control process to be executed by the controller in a modification according to one or more aspects of the present invention.

In the printing unit 11 of the modification, the controller 130 may perform a nip control process in accordance with a procedure as shown in FIG. 10. Hereinafter, referring to FIG. 10, the nip control process of the modification will be described. It is noted that explanations about the same steps as shown in FIG. 9 will be omitted.

Operations executed in steps S210 to S250 are the same as those in the steps S10 to S50. In S230, when the MFP 10 does not have a skew correction function for correcting skew of a recording sheet (S230: No), the controller 130 determines whether the pickup arm 26 is in the second state, through detection using the arm state detector (S260). When determining that the pickup arm 26 is not in the second state (S260: No), the controller 130 sets the pickup arm 26 to the second state (S250). When determining that the pickup arm 26 is in the second state (S260: Yes), or after setting the pickup arm 26 to the second state (S250), the controller 130 performs a nipping operation (S280). Operations executed in S280 and S290 are the same as those in S80 and S90 as shown in FIG. 9.

Even though the feed motor 76 is driven to rotate in the first one of the forward and backward directions, when the pickup arm 26 is switched to the second state, the pickup roller 25 is apart from the recording sheet placed in the sheet feed cassette 78. Therefore, the recording sheet is not conveyed from the sheet feed cassette 78. Meanwhile, the first feed roller 60 and the pinch roller 61 are driven by a driving force that is transmitted by the feed motor 76 rotating in the first one of the forward and backward directions, so as to nip a recording sheet (in contact with the nipping point 60A between the first feed roller 60 and the pinch roller 61) between the first feed roller 60 and the pinch roller 61. Thus, it is possible to nip the recording sheet between the first feed roller 60 and the pinch roller 61 while preventing a recording sheet from being wrongly fed from the sheet feed cassette 78.

Further, the same registration sensor 110 performs an operation of detecting a recording sheet placed on the manual sheet feed tray 20 that contacts the nipping point 60A between the first feed roller 60 and the pinch roller 61 and an operation of detecting a recording sheet placed in the sheet feed cassette 78 that is brought by the pickup roller 25 into contact with the nipping point 60A. Therefore, it is possible to decrease the number of detectors for detecting a recording sheet (e.g., the registration sensor 110) that are provided to the MFP 10.

What is claimed is:

1. An image recorder comprising:

a first tray configured such that a sheet is placed thereon;

a driving source configured to generate a driving force in any of a first direction and a second direction different from the first direction;

a feed roller unit configured to, in response to receipt of the driving force in the first direction from the driving source, nip a leading end of the sheet placed on the first tray;

a function executing mechanism configured to, in response to receipt of the driving force in the first direction from the driving source, execute a predetermined functional operation;

a switching mechanism configured to switch between:

a first state to allow the function executing mechanism to execute the predetermined functional operation; and a second state to forbid the function executing mechanism to execute the predetermined functional operation;

a transmission mechanism configured to:

transmit the driving force in the first direction from the driving source to the feed roller unit and the function executing mechanism; and transmit the driving force in the second direction from the driving source to the feed roller unit and the switching mechanism;

a sheet detector configured to detect the sheet placed on the first tray; and a controller configured to:

in response to the sheet detector detecting the sheet placed on the first tray, control the driving source to generate the driving force in the second direction such that the switching mechanism, which receives the driving force in the second direction from the driving source via the transmission mechanism, switches to the second state; and thereafter control the driving source to generate the driving force in the first direction such that the feed roller unit, which receives the driving force in the first direction from the driving source via the transmission mechanism, nips the sheet on the first tray.

2. The image recorder according to claim 1, further comprising:

a recording head configured to discharge ink from one or more nozzles; and a cap configured to move between:

a first position where the cap contacts the recording head to cover the nozzles; and a second position where the cap is apart from the recording head, wherein the function executing mechanism comprises a suction mechanism configured to communicate with the cap and suck ink from the nozzles, wherein the predetermined functional operation includes an operation of the suction mechanism to suck ink, and wherein the switching mechanism is configured to switch between:

the first state to establish communication between the suction mechanism and the cap; and the second state to block the communication between the suction mechanism and the cap.

3. The image recorder according to claim 1, further comprising a switch detector configured to detect whether the switching mechanism is in the second state, wherein the controller is configured to, when the sheet detector detects the sheet on the first tray, and the switch detector detects that the switching mechanism is in the second state, control the driving source to generate the driving force in the first direction such that the feed roller unit nips the sheet on the first tray, without controlling the driving source to generate the driving force in the second direction.

4. The image recorder according to claim 2, further comprising a cap detector configured to detect whether the cap is in the second position, wherein the controller is configured to, when the sheet detector detects the sheet on the first tray, and the cap detector detects that the cap is in the second position, control the driving source to generate the driving force in the first direction such that the feed roller unit nips the sheet on the first tray, without controlling the driving source to generate the driving force in the second direction.

5. The image recorder according to claim 1, further comprising a second tray configured such that a sheet is placed thereon, wherein the function executing mechanism comprises a pickup roller configured to contact the sheet on the second tray and feed the sheet from the second tray to the feed roller unit, wherein the predetermined functional operation includes an operation of the pickup roller to feed the sheet on the second tray, wherein the switching mechanism comprises a pickup arm configured to support the pickup roller rotatably, and wherein the switching mechanism is configured to switch the pickup arm between:

the first state where the pickup roller contacts the sheet on the second tray; and the second state where the pickup roller is apart from the sheet on the second tray.

6. The image recorder according to claim 5, wherein the sheet detector is configured to detect the sheet fed by the pickup roller from the second tray to the feed roller unit.

* * * * *